US005737775A

United States Patent [19]

Schwartz

[11] Patent Number: 5,737,775

[45] Date of Patent: Apr. 14, 1998

[54] STICK-ON SHIRT POCKET AND ADVERTISING DISPLAY

[76] Inventor: Frederick B. Schwartz, 4683 Mission Blvd., San Diego, Calif. 92109

[21] Appl. No.: 726,912

[22] Filed: Oct. 7, 1996

Related U.S. Application Data

[60] Provisional application No. 60/005,036, Oct. 10, 1995.

[51] Int. Cl.[6] ..... A41D 27/20

[52] U.S. Cl. ..... 2/247; 2/243.1; 2/94; 2/250; 2/252

[58] Field of Search ..... 2/69, 69.5, 46, 2/47, 48, 49.1, 49.2, 49.3, 49.4, 49.5, 50, 51, 57, 75, 80, 83, 104, 105, 106, 113, 114, 115, 247, 248, 249, 250, 251, 252, 253, 244, 243.1; 428/79

[56] References Cited

U.S. PATENT DOCUMENTS

| | | | |
|---|---|---|---|
| 2,686,313 | 8/1954 | Seidler | 2/75 |
| 2,884,979 | 5/1959 | Corbe | 150/35 |
| 2,986,743 | 6/1961 | Eilen | 2/247 |
| 3,109,578 | 11/1963 | Davis | 229/62 |
| 3,133,690 | 5/1964 | Lui | 229/53 |
| 3,372,724 | 3/1968 | Rouse | 150/30 |
| 3,426,958 | 2/1969 | Gore | 229/53 |
| 3,508,700 | 4/1970 | Kelly | 229/53 |
| 3,510,052 | 5/1970 | Ruda | 229/62 |
| 3,561,670 | 2/1971 | Segal | 229/53 |
| 3,589,595 | 6/1971 | White | 229/66 |
| 3,592,381 | 7/1971 | Brody | 229/74 |
| 3,611,444 | 10/1971 | Rector | 2/247 |
| 3,840,901 | 10/1974 | Eyster | 2/247 |
| 3,900,059 | 8/1975 | Kirk et al. | 150/1 |
| 4,139,037 | 2/1979 | McGuigan | 150/11 |
| 4,218,781 | 8/1980 | Liberman | 2/247 |
| 4,321,710 | 3/1982 | Off | 2/247 |
| 4,328,895 | 5/1982 | Jaeger | 206/496 |
| 4,335,769 | 6/1982 | McManus | 150/1 |
| 4,365,355 | 12/1982 | Off et al. | 2/247 |
| 4,418,733 | 12/1983 | Kallman | 383/11 |
| 4,548,375 | 10/1985 | Moss | 248/205.2 |
| 4,579,277 | 4/1986 | Gendron | 229/74 |
| 4,598,935 | 7/1986 | Stewart | 283/81 |
| 4,602,390 | 7/1986 | Morera et al. | 2/251 |
| 4,610,904 | 9/1986 | Mahn, Sr. et al. | 428/79 |
| 4,656,673 | 4/1987 | Easton et al. | 2/247 |
| 4,801,081 | 1/1989 | O'Conner | 232/1 |
| 4,820,558 | 4/1989 | Sundberg | 428/34 |
| 4,978,231 | 12/1990 | Ling et al. | 383/11 |
| 5,044,772 | 9/1991 | Larson | 383/11 |
| 5,079,778 | 1/1992 | Sloot | 2/244 |
| 5,215,379 | 6/1993 | Pickard et al. | 383/37 |
| 5,499,403 | 3/1996 | Harrigan | 2/247 |

*Primary Examiner*—Jeanette E. Chapman
*Attorney, Agent, or Firm*—Henri J.A. Charmasson; John D. Buchaca

[57] ABSTRACT

A removable pocket is formed over a section of fabric such as the front of a shirt by adhesively securing to the fabric a treated and embossed label-type appliqué made of two plies of paper permanently bonded about their peripheries and in which a slit along a top edge allows access to the pouch thus formed between plies. The pouch may be filled with merchandise and temporarily sealed with a removable strip.

8 Claims, 2 Drawing Sheets

STICK-ON SHIRT POCKET AND ADVERTISING DISPLAY

PRIOR APPLICATION

This application is a continuation-in-part of provisional application Ser. No. 60/005,036 filed Oct. 10, 1995.

FIELD OF THE INVENTION

This invention relates to the manufacture of wearing apparel and the application thereto of badges, insignia and other information-carrying devices and more specifically to a way of quickly and removably forming a message-carrying pocket over the surface of a garment.

BACKGROUND OF THE INVENTION

Jackets, shirts and similar garments are often decorated in their frontal area with embroidery or appliqués, and adorned with badges or message-carrying buttons. Many of such garments, especially T-shirts, do not have breast pockets which are so convenient for holding pens, sunglasses or small documents. People are fond of displaying indicia of their membership in a particular group or organization, or of their enthusiasm and support for a sports team or popular idol.

The invention results from an attempt to combine in a single item, the convenience of an added pocket with a message or symbol-carrying device that can be quickly and removably placed on a piece of clothing.

SUMMARY OF THE INVENTION

The principal object of this invention is to provide a disposable pocket that can be removably affixed to a piece of clothing, and that can be marked with a decorative or informative graphic message.

Another object of the invention is to provide such a device in an inexpensive and easy to manufacture version that lends itself to a great variety of expressive configurations.

A further object of this invention is to provide a package for candy, chewing gum, and other small articles that can be affixed to a garment to form a reusable but removable and disposable pocket.

These and other valuable objects are achieved by forming a pocket over a section of a fabric such as the front of a shirt by adhesively securing to the fabric, a printed and embossed label-type appliqué made of two plies of paper permanently bonded about their peripheries and provided with a slit along a top edge which provides a peelable access to the pouch formed between the plies. The front outer surface of the pocket is preferably decorated with an emblem or advertising message that can be used to display ones affiliation with a club or other membership association, or ones support for a political candidate, sports team or favorite champion.

DESCRIPTION OF THE PREFERRED EMBODIMENT OF THE INVENTION

Figure 1:
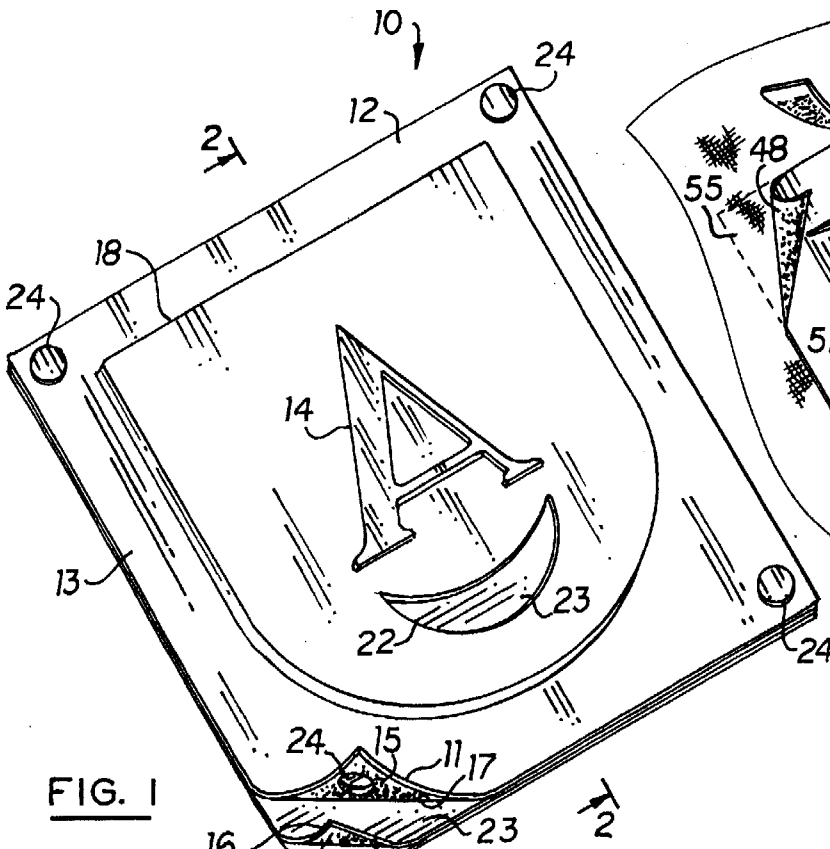
FIG. 1 is an isometric view of the preferred embodiment of the invention.
Figure 2:
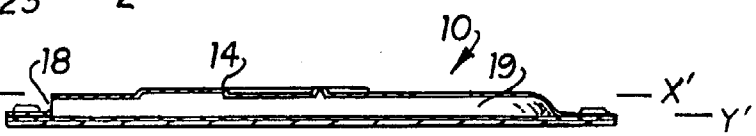
FIG. 2 is a cross-sectional view thereto taken along line 2—2 of FIG. 1.

Referring now to the drawing, there is shown in FIGS. 1 and 2 a multi-ply, disposable pocket 10 that can be removably applied to a preferably smooth and seamless woven fabric surface of a garment. The pocket comprises a first sheet of material 11 having a central portion 12 that has been embossed to raise it to a plane X—X' parallel and spaced-apart from the original plane Y—Y' of the remaining peripheral portion 13 of the sheet completely surrounding said central portion 12. The embossing depth may be limited to one or two millimeters (40 to 80 mils). Graphic information 14 such as a symbol, emblem, design, or written message is applied to the central portion 12 by embossing, printing, painting, silk-screening, or a combination of those methods. The back face 15 of the first sheet 11 is permanently bonded about its continuous peripheral portion 13 to the outer face of an intermediary sheet 16 with a strong rubber-based hot-melt adhesive 17 or by heat-sealing. A slit 18 cut along the upper edge of the central portion 12 provides access to the pouch 18A formed between the raised central portion of the first sheet and the intermediary sheet 11, 16. The entire inner side 19 of the intermediary sheet is covered with a layer of high-tack, acrylic adhesive 20 which retains a high coefficient of friction and provides a strong but breakable bond when placed in contact with another surface such as a woven fabric. From the time of manufacture until the pocket is readied to be applied to a garment, the layer of acrylic adhesive 20 on the entire inner side of the intermediary sheet is protected by a peelable film 21 which is impregnated with wax or silicon for easy separation from the adhesive. The first and intermediary sheets 11, 16 are preferably made of a strong, high-rag content, bond stock of paper, a vinyl-coated fabric, natural or synthetic, woven or pile fabric, or any synthetic pliable sheet material, or a laminated or non-laminated multi-ply combination thereof. The first sheet should have a minimum degree of ductility and a high resistance to tearing. In addition to, or in lieu of the embossed or printed graphic information 14 the central portion 12 can be die-cut to form a decorative pattern 22 through which a section of the outer side 23 of the intermediary sheet can be seen.

It thus can be understood that a removable and disposable pocket can be instantly formed over an outer or inner surface of a garment by peeling and pressing the inner side of the intermediary sheet against a section of the garment surface. A more permanent type of pocket can be formed by replacing the high-tack acrylic adhesive 20 with a stronger thermoplastic-type that would allow ironing the pocket over the cloth fabric.

It should be noted that decorative printing or embossing can also be applied to the peripheral section 13 of the first sheet as illustrated by the rivets simulated by the embossing 24 at the four corners of the device.

Figure 3:
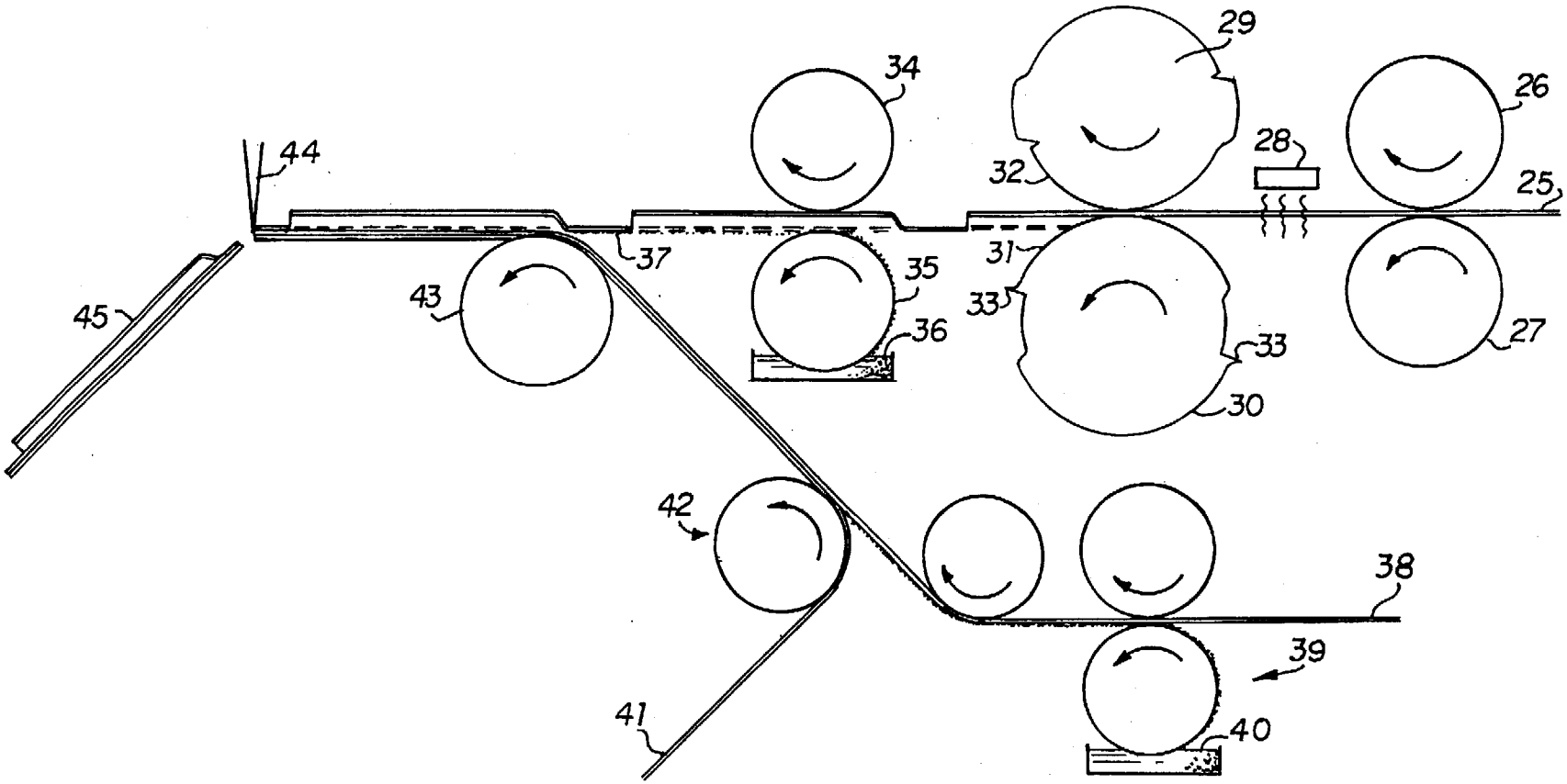
FIG. 3 is a diagrammatical illustration of its manufacturing process.

FIG. 3 groups in a single diagram, the various processes involved in the manufacturing of the pocket. It should be noted that those various processes are not necessarily performed in line and simultaneously but can be done at different times.

A web or ribbon of pliable sheet material 25 is first run through a pair of printing rollers 26, 27 which apply to its top surface a graphic decoration or printed message. The web is then left to dry or passed through a drying station 28 before being fed through a pair of embossing rollers 29, 30. The surfaces of those two rollers have mating opposite raised and depressed areas 31, 32 corresponding to the desired embossing pattern. One of the rollers mounts a perpendicular blade 33 which cuts the slit 18 in the upper edge of the central section 12 of the pocket. The embossed web is then run through another pair of rollers 34, 35. The surface of roller 35 on the back side of the web is constantly being loaded with the rubber-based, hot-melt adhesive 36 and contact only the non-embossed sections 37 of the web.

On a separate track, a similar ribbon or web 38 is first passed by another adhesive-applying roller mechanism 30 that coats its back side with the high-tack acrylic compound 40. A web 41 of peelable, protective film is then laid over the adhesive by another roller mechanism 42. The three webs 25, 38 and 41 are then brought together in a final assembling process before passing through a cutting knife 44 that separates the various pocket devices 45.

It should be understood that additional printing or decorating could be applied to either side of the second and third webs 38, 41.

Figure 4:
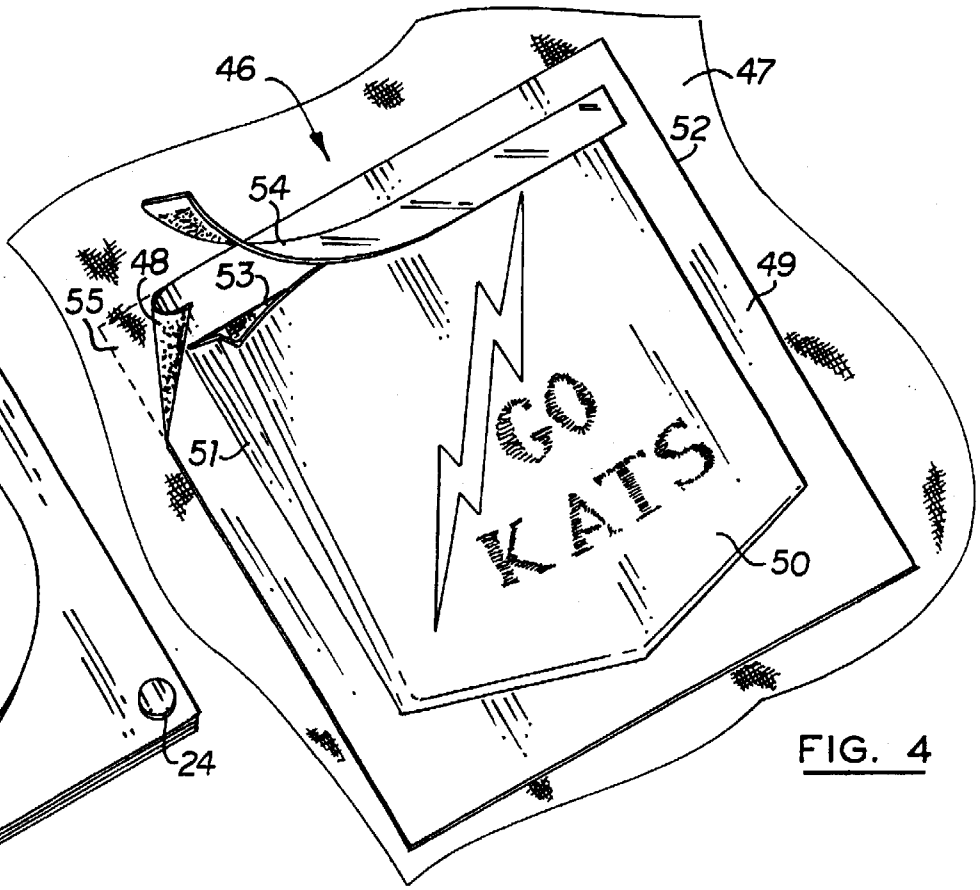
FIG. 4 is an isometric view of an alternate embodiment of the invention applied to a wearing apparel.

FIG. 4 illustrates an alternate embodiment of the invention in which a pocket 46 of a less complex configuration has been formed over a woven fabric section 47 of a garment surface. In this embodiment, the intermediary sheet 16 of the first embodiment has been completely omitted. The high-tack, acrylic adhesive has been applied to the back 48 of the marginal, not raised, peripheral section 49 of the single sheet for direct application to the garment woven fabric surface. The central portion 50 has been provided with side gussets 51, 52 which allow for a larger volume content of the pocket. The opening slit 53 is temporarily sealed by a peelable tape 54 allowing the pocket to be used as a container for candy or other items until the adhesive-protecting, peelable film 55 shown in dotted line is removed.

In an alternate manufacturing process, the entire back 48 of the single sheet is covered with the acrylic adhesive and covered with a commensurate peelable film 55. However, the central part of the film is peripherally cut to delineate the pocket compartment. That central part thus remains in place when the film 55 is peeled away from one of the corners. Only the adhesive-coated back of the peripheral section 49 is exposed and bonded to the fabric section 47. The central part of the film remains as an inner lining of the pocket. A second alternate manufacturing method consists of chemically neutralizing the central portion of the acrylic adhesive. These alternate processes can be conveniently practiced on presses used in the manufacture of die-cut pressure-sensitive labels. The gussets 51, 52 may be formed either by embossing or by preforming the central section 50 separately out of one or more compartments It should be understood that the same type of sealed container can be more conveniently implemented in connection with the earlier described preferred embodiment 10 of the invention.

While the preferred embodiments of the invention have been described, modifications can be made and other embodiments may be devised without departing from the spirit of the invention and the scope of the appended claims.

What is claimed is:

1. The combination of a garment having a smooth, continuous, woven cloth surface section and a disposable pocket, wherein said pocket comprises:

a first pliable sheet of material including a central portion and a continuous peripheral portion surrounding said central portion said first pliable sheet having a slit opening in said central portion;

means for removably bonding said continuous, peripheral portion to said cloth surface;

an intermediary sheet of pliable material having an outer side permanently bonded to said continuous peripheral portion, and an inner side having means for removably sticking upon said cloth surface; and wherein said first and intermediary sheets are made of paper.

2. A process for forming a series of pockets releasably attachable to a supporting surface which comprise the steps of:

delineating successive areas defining said pocket outlines over a first web of pliable sheet material;

applying a strong adhesive to a marginal pheripheral portion of an inner face of each of said areas;

applying a breakable high-tack adhesive to the inner side of a second web of pliable sheet material substantially commensurate with said first web;

covering said side with a peelable third web of pliable sheet material substantially commensurate with said second web;

contacting said inner face of said first web with an outer side of said second web opposite said inner side for permanently securing said marginal pheripheral portion of said inner face of said first web to the said outer side; and cutting a slit through a part of each of said areas surrounded by a peripheral portion.

3. The process of claim 2, which further comprises embossing each of said areas to place a central portion exclusive of said peripheral portion in a plane parallel to and spaced-apart from, said second web.

4. The process of claim 2, which further comprises printing information on said third web.

5. A process for forming a pocket over a woven fabric section of a garment which comprises the steps of:

delineating an area defining said pocket outline over a first sheet of pliable material;

securing a continuous, marginal peripheral, portion of an inner face of said sheet to said fabric section;

wherein the step of securing comprises permanently bonding said peripheral portion to an outer side of a second sheet of pliable material, and removably securing an inner side of said second sheet opposite said outer side to said fabric section;

wherein said step of removably securing comprises attaching said inner side to said fabric section with a breakable adhesive; and which further comprises cutting a slit along an edge of said central portion to provide access to the space between said central portion and said second sheet; and applying a removable sealing strip over said slit.

6. The process of claim 4 which further comprises placing at least one article of manufacture within said space prior to applying said sealing strip.

7. A process for forming a pocket over a woven fabric section of a garment which comprises the steps of:

delineating an area defining said pocket outline over a first sheet of pliable material;

securing a continuous, marginal, peripheral portion of an inner face of said sheet to said fabric section; and cutting a slit through a part of said sheet surrounded by said peripheral portion; and wherein said step of securing comprises:

applying a layer of breakable adhesive to the inner face of said sheet;

covering said layer of adhesive with a peelable film;

removing a continuous, marginal peripheral portion of said peelable film; and applying said sheet to said fabric section.

8. A process for forming a pocket over a woven fabric section of a garment which comprises the steps of:

delineating an area defining said pocket outline over a first sheet of pliable material;

securing a continuous, marginal, peripheral portion of an inner face of said sheet to said fabric section; and cutting a slit through a part of said sheet surrounded by said peripheral portion; and wherein said step of securing comprises:

applying a layer of breakable adhesive to the inner face of said sheet; and chemically neutralizing a central portion of said layer of adhesive.

* * * * *

UNITED STATES PATENT AND TRADEMARK OFFICE

CERTIFICATE OF CORRECTION

PATENT NO. : 5,737,775

DATED : April 14, 1998

INVENTOR(S) : FREDERICK B. SCHWARTZ

It is certified that error appears in the above-identified patent and that said Letters Patent is hereby corrected as shown below:

In the drawing, sheet 1, Figure 1 the reference numeral 12 should be applied to the central portion of the pocket 10 having the letter A cut-out.

In the drawing, sheet 1, Figure 2, change reference numeral "19" to --18A--.

Signed and Sealed this

Thirtieth Day of June, 1998

*Attest:*

Bruce Lehman

BRUCE LEHMAN

*Attesting Officer*

*Commissioner of Patents and Trademarks*